US005538179A

United States Patent [19]

Cai

[11] Patent Number: 5,538,179

[45] Date of Patent: Jul. 23, 1996

[54] CONVERTIBLE CONTAINER

[75] Inventor: Liming Cai, West Chester, Pa.

[73] Assignee: Dopaco, Inc., Downingtown, Pa.

[21] Appl. No.: 360,635

[22] Filed: Dec. 21, 1994

[51] Int. Cl.[6] ..... B65D 5/42; B65D 5/4805

[52] U.S. Cl. ..... 229/125; 206/457; 229/114; 229/120.17; 229/146; 229/149; 229/901; 229/906

[58] Field of Search ..... 229/114, 125, 229/120.01, 120.09, 120.17, 146, 149, 901, 902, 906; 24/570, 571, 457; 206/457

[56] References Cited

U.S. PATENT DOCUMENTS

| | | | |
|---|---|---|---|
| D. 95,545 | 5/1935 | Reynolds | 24/571 |
| 1,114,041 | 10/1914 | Richardson | 229/125 |
| 1,490,341 | 4/1924 | Olney | 206/457 |
| 2,072,753 | 3/1937 | Ikeda et al. | 229/125 |
| 2,361,597 | 10/1944 | Buttery | 229/149 |
| 2,897,958 | 8/1959 | Tarleton et al. | 229/125 |
| 2,968,890 | 1/1961 | Nisco | 206/457 |
| 3,209,941 | 10/1965 | Krake | 229/120.09 |
| 3,713,578 | 1/1973 | Johnson | 229/125 |
| 3,799,332 | 3/1974 | Jeronimus | 229/125 |
| 4,068,353 | 1/1978 | Speers et al. | 229/125 |
| 4,799,594 | 1/1989 | Blackman | 229/125 |
| 4,848,648 | 7/1989 | Eisman . | |
| 4,856,707 | 8/1989 | Lorenz . | |
| 4,877,178 | 10/1989 | Eisman . | |
| 4,951,865 | 8/1990 | Eisman . | |
| 5,188,284 | 2/1993 | Eisman . | |
| 5,249,736 | 10/1993 | Eisman . | |
| 5,364,018 | 11/1994 | Carlsson | 229/906 |

*Primary Examiner*—Gary E. Elkins
*Attorney, Agent, or Firm*—Dennison, Meserole, Pollack & Scheiner

[57] ABSTRACT

A convertible food container including two outwardly opening shells having inner walls interconnected along a common upper edge thereof for hinged movement of the shells between an open tray-forming position and a closed carton-forming position. The inner walls include integral tongue and recess lock components which are manually engageable to prevent movement of the inner walls, and hence the shells, relative to each other. A separate retainer enables a locking together of two overlying and facing containers in the open positions thereof.

17 Claims, 3 Drawing Sheets

CONVERTIBLE CONTAINER

BACKGROUND OF THE INVENTION

Food cartons or containers, for use in particular in the fast food industry, are disposable items conventionally formed of lightweight paperboard folded and fixed in a predetermined configuration.

Such containers are intended for a wide variety of products. Thus, the containers have heretofore of necessity been made in a variety of configurations, for example the conventional closed single chamber clamshell for hamburgers and the like, open multi-compartment serving trays adapted to accommodate different foodstuffs to be consumed on the restaurant premises, multi-compartment covered containers to accommodate separate foods in a single closed carton, and the like.

The necessity for separate specialized containers requires maintaining sufficient storage space for an adequate supply of each of the specialized containers used by the fast food establishment. Specialized containers also require the dispenser of the food to select among multiple different types of containers with each order processed. Additional problems involve differing manufacturing techniques and equipment, separate packaging, etc.

All of the above factors contribute to increasing the expense of the products provided. This in turn is particularly undesirable with regard to fast food containers which are throwaway items, and, to be economically acceptable, should not be a major factor in determining the price of the food dispensed.

SUMMARY OF THE INVENTION

The container of the present invention is, through a unique capability of converting into forms for use in distinctly different situations, particularly desirable for a variety of reasons, all of which contribute to the economic feasibility of the container.

More specifically, the container of the invention eliminates the necessity for the manufacture and stocking of different containers, each specifically formed for a single type usage. Rather, the container of the invention, through an integral lock assembly, is convertible to accommodate distinctly different foods. The lock assembly requires no additional materials, the major cost of the product, and only a slight modification in the actual manufacturing equipment by the provision for the formation of selected cut and fold lines in blanks similar to blanks of the type conventionally used in the formation of clamshell cartons. In one form of carton to which the container of the invention can convert, an auxiliary retainer, formed of a single flat sheet or panel of paperboard or the like, can be utilized as an additional securing means as well as a display means presenting, as an example, a logo associated with the fast food establishment.

The container of the invention is folded from a single blank and includes two compartment-defining shells integrally joined along a common fold or hinge line comprising a common upper edge of the inner walls of the two shells. These inner walls are of equal height and extend perpendicularly to the base or base walls of the two shells for flush abutment against each other with the shells in adjacent alignment. The remaining or outer walls of each shell flare slightly outward relative to each other as they project from the corresponding base.

The perpendicular or 90° inner walls, joined along a common outer edge, allow for a smooth hinged folding of one shell over the other without a buckling of the inner walls relative to each other as would interfere with the smooth opening and closing of the shells relative to each other.

The resultant carton is in the nature of a clamshell carton particularly useful in providing a closed container for a single food item, most notably a hamburger or similar sandwich. As in the conventional clamshell construction, the three diverging walls of one shell will preferably be of a slightly greater height than the walls of the second shell to slightly telescope thereover and provide a sealed peripheral edge portion. Similarly, appropriate securing means, such as projecting lugs and complimentary recesses, will be provided to latch the shells in the closed position wherein a single enlarged chamber is provide.

The above-described basic container is equally adapted for use as a fixed open tray with two separate compartments. Any tendency for one shell to freely close over the other is resisted by an integral lock assembly formed within the adjacent inner walls for a locking engagement between the inner walls in the open position of the container. The locking assembly is defined directly from the portion of the blank forming the inner walls, thereby avoiding the necessity of additional material. Further, the lock assembly is easily and quickly engaged by a simple finger manipulation for a converting of the clamshell carton into an open two-compartment tray.

The described basic container is also usable with a second duplicate container in the formation of a multi-chamber closed carton. This involves inverting one open container to overlay and downwardly engage over a second open container. The containers are rotated 180° end-to-end to telescopically engage the outer portions of the projecting walls. The inner walls, and more particularly the hinge lines thereof, overlay and engage or substantially engage each other. The securing latches are configured to allow for an appropriate locking of the upper and lower reversed containers whereby two double height chambers are formed.

The inner walls of each of the containers of the closed multiple-chamber carton are preferably interlocked by the corresponding lock assemblies. As an additional retaining means, or as a means for securing the overlying containers in a stable relationship without using the lock assemblies, at least one retainer can be engaged between the overlying pairs of inner walls of the closed carton in a manner which clamps the common outer edges of the two pairs of inner walls against each other to preclude movement of the containers relative to each other. The retainer will simultaneously preclude movement of the shells of each container relative to each other whereby a highly stable multi-chamber carton is provided. The retainer will project to one side of the closed carton for easy manipulation and as a means for displaying a company logo, a decorative motif, or the like.

Other features of the invention are considered to reside in the specifics of the structure as more fully hereinafter detailed.

DESCRIPTION OF THE PREFERRED EMBODIMENTS

Figure 3:
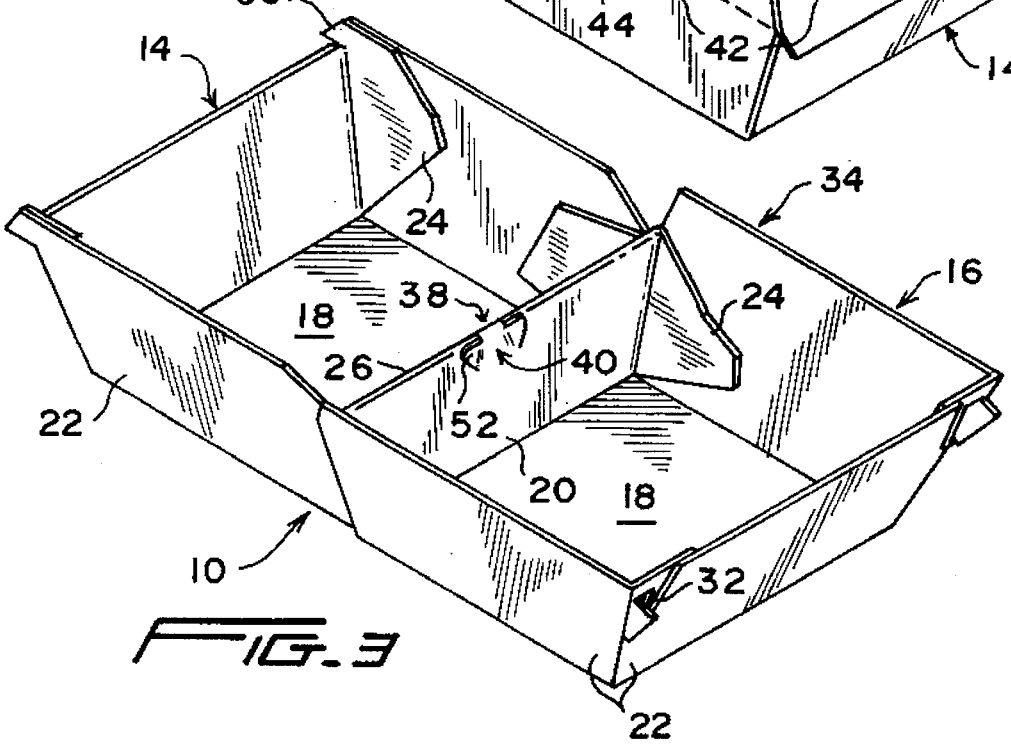
FIG. 3 is a top perspective view of the opened tray configuration of the container of the invention.
Figure 4:
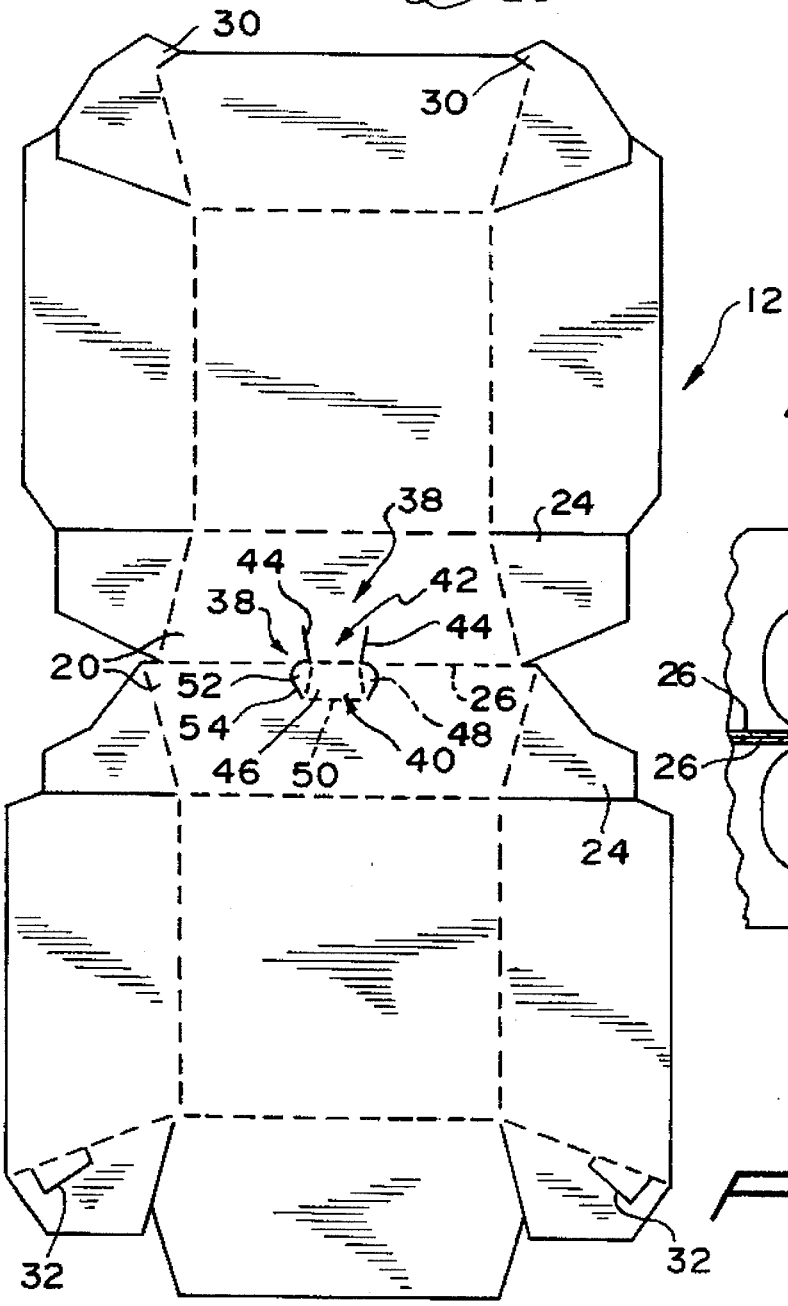
FIG. 4 is a plan view of the blank from which the container is formed.

Referring now more specifically to the drawings, the basic configuration of the container 10 will be best appreciated from FIGS. 3 and 4 which respectively illustrate the erected container and the unitary or one piece blank 12 from which the container 10 is folded.

Figure 1:
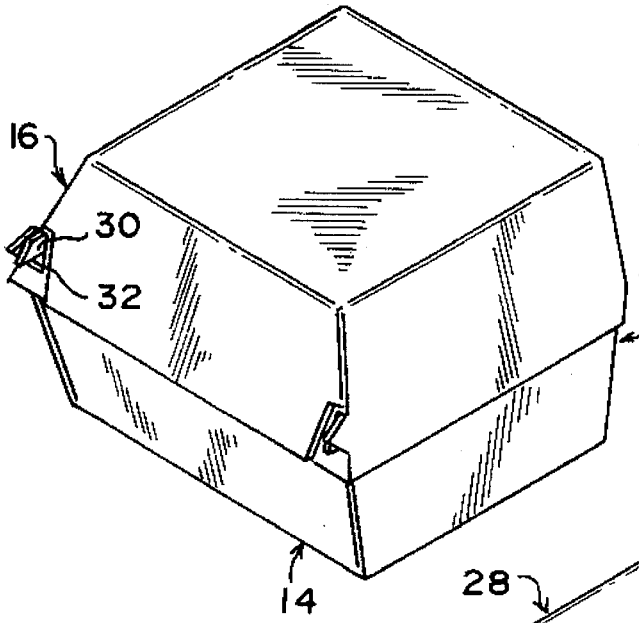
FIG. 1 is a front and top perspective view of the carton configuration of the container of the invention.
Figure 2:
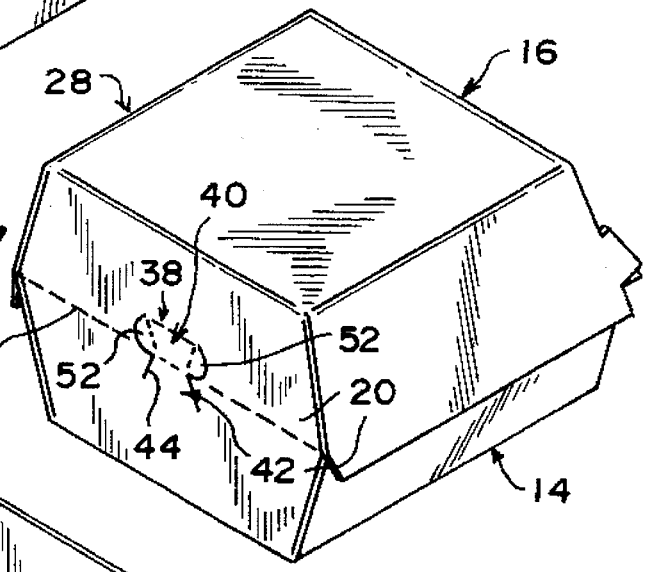
FIG. 2 is a rear perspective view of the carton of FIG. 1.

The container 10 includes two shells 14 and 16, each including a planar base or base panel 18, an inner wall 20 and outer walls 22. The walls 20 and 22 of each shell are integrally joined to the base about the periphery thereof and folded to project laterally therefrom. The inner walls 20 extend perpendicular to the respective bases 18 and the walls 22 flare slightly outward. The walls 20 and 22, at the ends thereof, are joined and sealed to adjacent walls by appropriate glue flaps 24 to define outwardly opening compartments. The outer walls 22 of the shell 16 are of a greater height than the outer walls 22 of the shell 14 to allow for a smooth closing of the shell 16 over the shell 14 in the manner suggested in FIGS. 1 and 7. The inner walls 20 have a common upper edge 26 which defines a fold line forming a hinge for rotation of the shell 16 relative to the shell 14 to define the clamshell carton 28 of FIGS. 1 and 2.

The perpendicular or right angle extension of the inner walls 20 from the respective base panels 18 allow for a smooth and unencumbered opening and closing of the shells 14 and 16 relative to each other when used to define the clamshell carton 28 in which the two compartments define a single substantially double height interior chamber. Such a carton, as is the case with conventional clamshell cartons, will normally be used to contain hamburgers, single food items, and the like.

Figure 7:
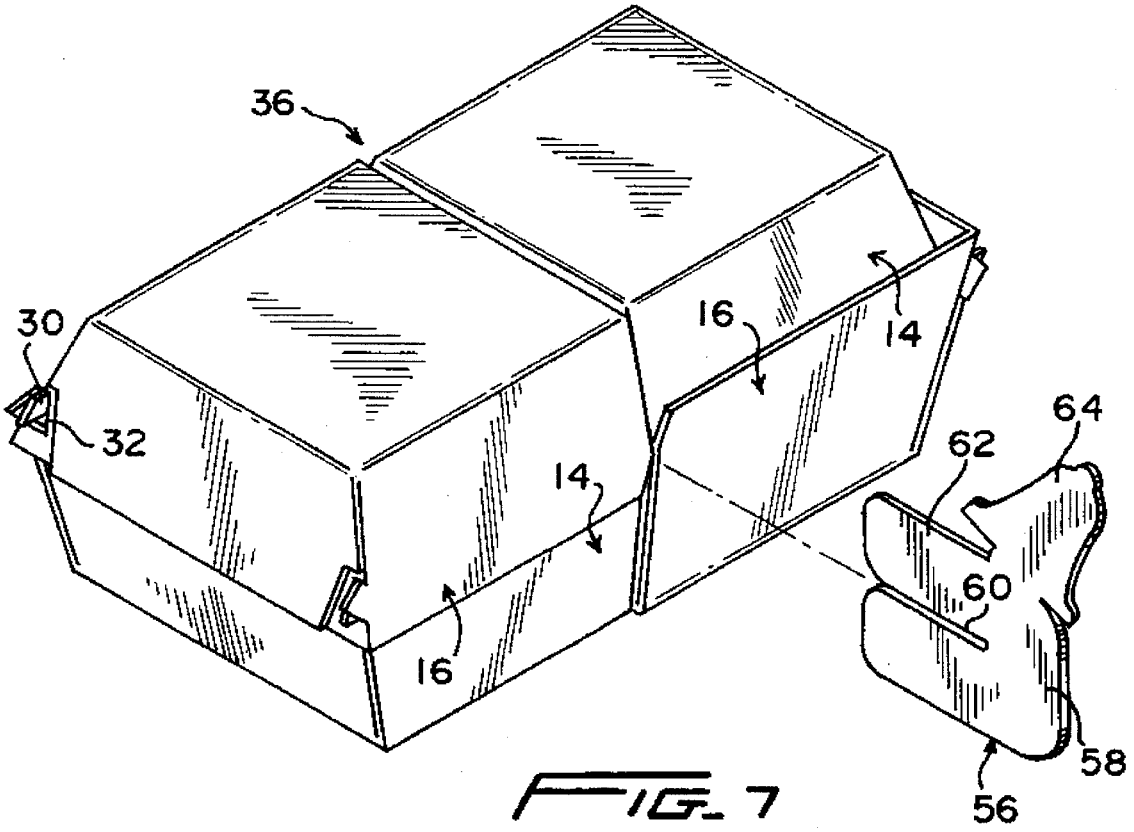
FIG. 7 is a perspective view of the container, used with a companion container to define a multi-chamber closed tray carton, the retainer is aligned for engagement with the two containers.
Figure 8:
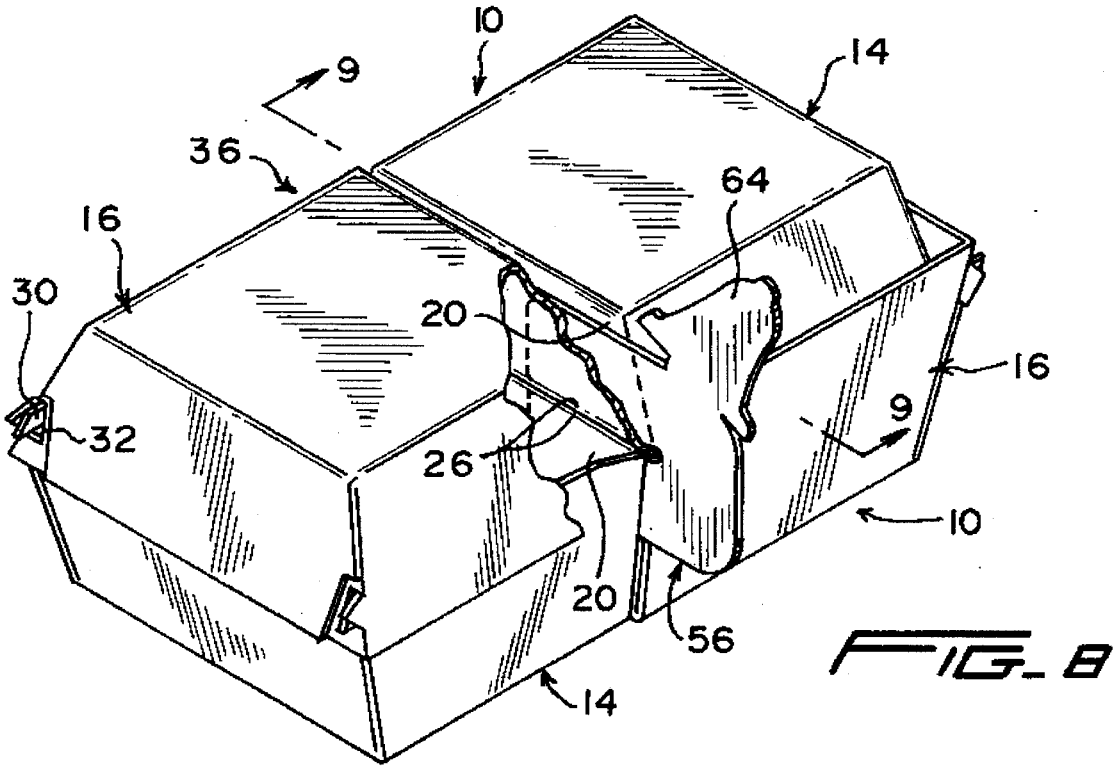
FIG. 8 is a similar perspective view with the retainer engaged and with portions of the upper container broken away for purposes of illustration.

In order to releasably secure the closed shells of the carton 28, appropriate latch means will be integrally formed from the walls 22 remote from the corresponding inner walls 20. Such latch means, as illustrated, can comprise projecting tabs 30 extending from shell 14 and engaged through corresponding slots 32 in shell 16. The relationship between the latching lugs 30 and the latching slots 32 is such as to, relying on the inherent flexibility of the material of the container, allow for a latching and subsequent release of the shell 16 relative to the shell 14 as it is closed thereover. Similarly, with the container 10 fully open in the tray configuration 34 of FIG. 3, a duplicate container, inverted and turned end-for-end, can be engaged over the first container to form a dual-chamber closed carton 36 as illustrated in FIGS. 7 and 8 with the overlying containers 10 releasably secured to each other by the latch lugs and slots. With such an arrangement, the lugs 30 of one container will engage through the slots 32 of the second container in a manner readily apparent from FIGS. 7 and 8. Further, it is to be appreciated that the latch lug and slot arrangement can vary as long as the components retain the ability to both releasably latch one shell to the other and one container to the other. For example, the lugs and slots can be laterally directed rather than longitudinally directed as illustrated.

Turning again to FIG. 3 wherein the container 10 is illustrated as a dual compartment upwardly opening tray 34, the formation of the inner walls 20 perpendicular to the bases 18 allow for a flush abutment of these walls against each other in the fully opened position of the shells 14 and 16, thus providing a flat-bottom tray for the serving of two separate foodstuffs.

In order to stabilize the shells 14 and 16 relative to each other in the opened position for proper use of the container as a tray 34, provision must be made to avoid any tendency for the shells to fold or close on each other. Accordingly, the container 10 of the invention, utilizing no additional material, provides an integral lock assembly 38 in and for selective engagement between the inner walls 20. The lock assembly, when disengaged, allows free folding movement of the shells 14 and 16 relative to each other for use in the formation of the clamshell carton 28. Upon a locking of the lock assembly 38, which can only be effected in the open tray configuration of FIG. 3, the inner walls 20 are locked together in a manner whereby pivotal movement therebetween is precluded, thus providing the desired rigid two compartment or chamber tray 34.

Figure 5:
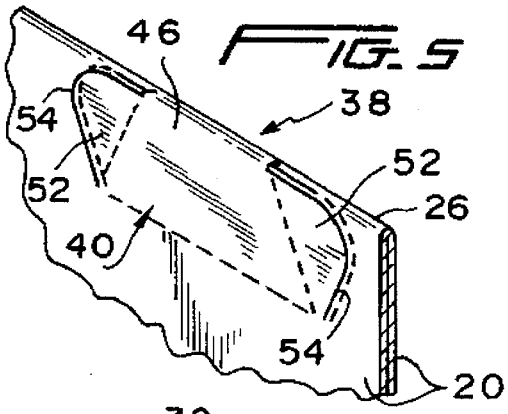
FIG. 5 is a perspective detail of the lock assembly, prior to engagement, which fixes the container in the tray configuration of FIG. 3.
Figure 6:
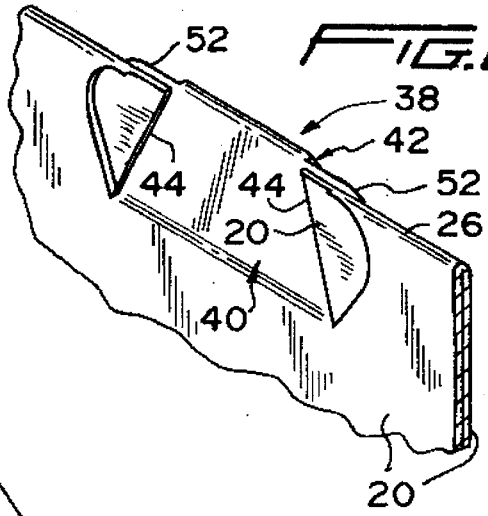
FIG. 6 is a similar perspective detail with the lock assembly engaged.

With reference in particular to FIGS. 4, 5 and 6, it will be noted that the lock assembly 38 includes a tongue member 40 on one inner wall and an opening or recess defining member 42 on the second inner wall. The opening defining member 42 is formed by a pair of laterally spaced cut or severance lines 44 extending inward from longitudinally spaced points along the hinge-forming outer edge 26 at approximately 65° to the edge 26. The recess or opening for the tongue member 40 is formed by laterally flexing the member 42 out of the plane of the corresponding inner wall 20 to provide for accommodation of the tongue member between the severance lines 44.

The tongue member 40 includes a central portion 46 of substantially equal size and shape to the opening-forming member 42 and defined by inwardly or downwardly diverging fold lines 48 extending from points on the hinge-forming outer edge 26 common with the points from which the severance lines 44 extend. The inner or lower ends of the diverging fold lines 48 align on a transverse imaginary or defined fold line 50 paralleling the common outer edge 26. The tongue member 40 is completed by a pair of side locking tabs or ears 52 coplanar with the central portion 46 of the tongue member 40 and integral therewith along the diverging fold lines 48. Each of these tabs 52 has the outer periphery thereof defined by a cut or severance line 54. For ease of engagement and disengagement, and to provide an enhanced interlock, the tab outer peripheries taper from a maximum width immediately inward of the inner wall upper edge 26 to a substantially narrower width toward the lower or inner fold line 50. The tabs 52 project laterally beyond the opening-forming severance lines 44 to the opposite sides of the opening-forming member 42. As will be appreciated from the foregoing description and FIGS. 4–6, the lock assembly 38 includes a length of the common upper edge 26 of the inner walls 20 which provides an integral joinder between the upper ends of the tongue member 40 and member 42 for simultaneous manipulation thereof. Thus, the formation of the tongue-receiving opening or recess is effected as the tongue is engaged therethrough.

FIG. 5 illustrates the lock assembly 38 prior to engagement. As such, the inner walls 20 of the two shells 14 and 16 are, other than for the hinge defined along the common upper edge 26, free of each other for use of the container 10 as a clamshell carton 28.

FIG. 6 illustrates the lock assembly engaged. In engaging the lock assembly 28, lateral pressure is applied to the tongue member 40 toward the member 42 to flex the member 42 laterally away from the corresponding inner wall 20. The member 42 folds about either an imaginary or a defined fold line between the lower ends of the severance lines 44. Continued pressure on the tongue member moves the tongue member through the defined opening between the severance lines 44 with the inherent resiliency of the paperboard material allowing the lock tabs 52 to flex toward each other for forced reception through the opening. Once beyond the opening, the tabs tend to unfold and return to their original position. This unfolding movement of the tabs 52 is enhanced by the inherent tendency of the tongue member 40 to retract from the opening, thereby providing for a positive engagement of the tabs against the inner face of the wall 20 from which the member 42 is defined. The engaged lock assembly provides a positive interlock between the two abutting inner walls 20 whereby movement of the hinge-joined shells 14 and 16 relative to each other is prevented, and the container 10 is fixed in a configuration defining a dual chamber upwardly opening tray, the interior of which is divided by a fixed central partition comprising the interlocked inner walls. Should a customer wish to use the tray 34 as a "take out" container for a partially consumed meal, the lock assembly 38 can be easily disengaged by forcing the tongue member back through the opening and closing one shell upon the other.

Depending upon the size of the container, more than one lock assembly 38 can be provided along the length of the engaged inner walls 20.

Figure 9:
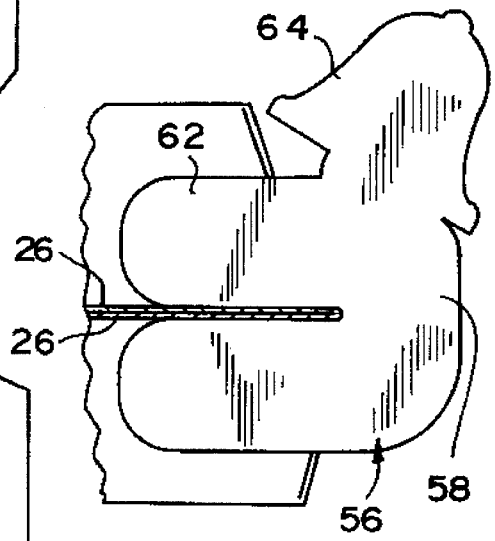
FIG. 9 is a cross-sectional detail illustrating the positioned retainer and taken generally in the plane of line 9—9 in FIG. 8.

FIGS. 7 and 8 illustrate the use of two of the containers 10 in the formation of a closed two-chamber carton 36. The latch assemblies 30, 32 allow for a latching of the two containers to each other upon a reversing and inverting of the uppermost container, thereby providing two enlarged interior chambers separated by a transverse partition consisting of the abutting upper and lower pairs of inner walls 20 which engage each other along the two outer edges 26 as best seen in FIGS. 8 and 9. While the engaged containers will maintain a stable relationship, to avoid any tendency for the individual containers 10 to fold, particularly when separating the containers or opening the carton 36, it will normally be advisable to engage the lock assemblies 38, providing in effect two stable trays similar to the tray of FIG. 3.

As an additional retaining means between the overlying containers 10, it is proposed that a separate retainer 56 be provided. This retainer 56, a flat panel or sheet of the same shape-sustaining material as the container 10, includes an elongate body portion 58 with opposed ends and opposed longitudinal edges. An elongate slot 60 extends inward from one end thereof to form two wide furcations 62 having slightly rounded outer ends. The retainer 56 also preferably includes a coplanar upwardly directed combined handle and display portion 64 configured to display a restaurant logo or any other appropriate motif.

In use, and as will be appreciated from FIGS. 7–9, the retainer 56 is slid between the two shells of each of the engaged containers to receive the two outer edges 26 in a clamped relationship within the slot 60 with the furcations 62 respectively engaging between the adjacent inner walls 20 of the upper container and the adjacent inner walls 20 of the lower container. In this manner, a positive interlock is provided between the carton-forming containers of FIGS. 7 and 8 at an intermediate point between the latch engaged outer ends for a more secure carton. The engaged retainer 56, depending upon the weight of the contents of the closed carton 36, can actually comprise a handle means for handling or at least assisting in the handling of the carton. In such case, the design or display portion 64, depending again on the nature thereof, will provide a convenient grip means. It will also be recognized that the retainer 56 can be used and will stabilize the closed containers without the lock assemblies 38 being engaged.

From the foregoing, it will be recognized that the distinctive convertible container of the invention is basically arrived at by modifying a conventional clamshell carton in a simple although highly unique manner requiring only minor modification in the manufacturing procedure. No additional material expenses, the major cost of such containers, are involved.

In summary, the rear or inner walls of the two shells are formed perpendicular to the bases or base walls and incorporate, through an arrangement of cut lines and fold lines, a coplanar tongue and opening lock assembly which does not interfere with the opening and closing of the shells in the manner of a conventional clamshell carton. Upon engagement of the lock assembly, through simple finger pressure, the shells lock into abutting horizontally aligned relationship, forming a multi-compartment tray with upwardly opening chambers. Upon use with a duplicate inverted overlying tray, a multi-compartment closed carton is formed with closed chambers. As desired, the multi-compartment closed carton can be centrally reinforced by a retainer engaged between the overlying containers and presenting, preferably, a decorative or identifying motif. The retainer, depending upon the particular configuration thereof, can also be utilized as a means for facilitating gripping or handling of the multi-compartment carton.

While the container has been illustrated as comprising two generally rectangular shells, the inventive features can also be utilized with shells of other configurations. Any such variations will incorporate the hinge-joined inner walls which in the open position of the shells are in abutting parallel relationship and have the lock assembly of the invention incorporated therein.

The described embodiments are illustrative of the invention and are not to be considered as limitations on the scope of the invention. Rather, the invention is to be limited only by the scope of the claims following hereinafter.

I claim:

1. A convertible food container comprising first and second adjacent and outwardly opening compartments, said compartments having a wall structure therebetween, hinge means on said wall structure for pivotal movement of said second compartment between a first open position and a second closed position, said second compartment in said open position generally paralleling said first compartment with both compartments opening upwardly and defining two open chambers, said second compartment in said closed position overlying said first compartment and opening downward, closing said upwardly opening first compartment and defining one closed chamber therewith, and lock means on said wall structure for selectively retaining said second compartment in said open position and precluding movement to said closed position, said wall structure comprising first and second inner walls, one as a portion of each compartment, each compartment including peripheral outer walls and a base joined to said wall structure and to said peripheral outer walls, said first and second inner inner walls being integrally joined along a common outer edge, said first and second inner walls being foldable along said common edge to define said hinge means, said base of each compartment being joined to said wall structure at an angle of 90°, and said peripheral walls of each compartment flaring slightly outwardly from the corresponding base.

2. The food container of claim 1 wherein said hinge structure is integral with and defined by said wall means.

3. The container of claim 2 including cooperating latch components integrally defined on said compartments remote from said first and second inner walls for releasably locking said compartments in said closed position.

4. A convertible food container comprising first and second adjacent and outwardly opening compartments, said compartments having a wall structure therebetween, hinge means on, integral with and defined by said wall structure for pivotal movement of said second compartment between a first open position and a second closed position, said second compartment in said open position generally paralleling said first compartment with both compartments opening upwardly and defining two open chambers, said second compartment in said closed position overlying said first compartment and opening downwardly, closing said upwardly opening first compartment and defining one closed chamber therewith, and lock means on said structure for selectively retaining said second compartment in said open position and precluding movement to said closed position, said wall structure comprising first and second inner walls, one as a portion of each compartment, each compartment including peripheral outer walls, said first and second inner walls being integrally joined along a common outer edge, said first and second inner walls being foldable along said common edge to define said hinge means, said lock means comprising a tongue member integral with said first inner wall and tongue receiving means defined in said second inner wall, said tongue member in said open position of said compartments being selectively engaged with said tongue receiving means to preclude relative movement between said first and second inner walls.

5. The food container of claim 4 wherein said lock means is adjacent said common outer edge, severance lines in said first and second inner walls extending inward from said outer edge and defining said tongue member and said tongue receiving member; said tongue means extending inward from said outer edge and including a central portion of a predetermined width at and along said outer edge, at least one locking tab integral with and extending laterally from said central portion inward of said outer edge; said tongue receiving means being defined in said second inner wall by a pair of said severance lines laterally spaced from each other along said outer edge a width approximately equal to said predetermined width for passage of said central portion of said tongue therebetween, said portion of said second inner wall between said severance lines defining said tongue receiving means forming a folding flap pivotal away from said second inner wall to define an opening and accommodate passage of said tongue member therethrough, said at least one tab extending laterally beyond said opening and being foldable from a position coplanar with said central portion of said tongue member for forced passage through said opening and subsequent return toward said coplanar position after passage through said opening.

6. The container of claim 5 wherein said tongue member includes a second locking tab integral with and foldable relative to said central portion of said tongue member, said tabs extending in laterally opposed directions from said central portion for simultaneous passage through said opening.

7. The container of claim 6 wherein said central portion of said tongue member and said opening are each of a progressively great width inward from said common outer edge.

8. The container of claim 7 including cooperating latch components integrally defined on said compartments remote from said first and second inner walls for releasably locking said compartments in said closed position.

9. The container of claim 8 in combination with a second substantially duplicate container positioned in overlying facing relation to the first container and defining therewith a multiple chamber closed carton, the inner walls of each container aligning with the inner walls of the other container with said common outer edges of both containers being in parallel immediately adjacent relation to each other, and a separate retainer engaging said outer edges between the corresponding inner walls and clamping said outer edges toward each other and retaining said containers against each other.

10. The container of claim 9 wherein said retainer includes a flat elongate panel with opposed ends and opposed edges, an elongate slot defined in said panel extending inwardly from one end thereof, said common outer edges of said two containers being simultaneously received within said slot.

11. The container of claim 10 wherein said retainer includes a representation of a predetermined motif formed by an integral extension projecting outward relative to at least one of said ends or edges of said panel.

12. The container of claim 11 wherein said panel, between said slot and each of said edges thereof includes a flat panel portion of substantial transverse width.

13. A convertible food container comprising first and second adjacent and outwardly opening compartments, said compartments having a wall structure therebetween, hinge means on, integral with and defined by said wall structure for pivotal movement of said second compartment between a first open position and a second closed position, said second compartment in said open position generally paralleling said first compartment with both compartments opening upwardly and defining two open chambers, said second compartment in said closed position overlying said first compartment and opening downwardly, closing said upwardly opening first compartment and defining one closed chamber therewith, and lock means on said structure for selectively retaining said second compartment in said open position and precluding movement to said closed position, said wall structure comprising first and second inner walls, one as a portion of each compartment, each compartment including peripheral outer walls, said first and second inner walls being integrally joined along a common outer edge, said first and second inner walls being foldable along said common edge to define said hinge means, cooperating latch components being integrally defined on said compartments remote from said first and second inner walls for releasably locking said compartments in said closed position, and a second substantially duplicate container in combination therewith position in overlying facing relation to the container and defining therewith a multiple chamber closed carton, the inner walls of each container aligning with the inner walls of the other container with said common outer edges of both containers being in parallel immediately adjacent relation to each other, and a separate retainer engaging said outer edges between the corresponding inner walls and clamping said outer edges toward each other and retaining said containers against each other.

14. In combination, first and second convertible containers for foodstuffs, each container comprising first and second shells respectively defining first and second adjacent and outwardly opening compartments, said shells of each container each having an inner wall with the inner walls of each container having a common outer edge defining hinge means for selective pivotal movement of said second shell to a closed position overlying said first shell, said second container being positioned in overlying facing relation to the first container and defining therewith a multiple chamber closed carton, the inner walls of each container aligning with the inner walls of the other container with the common outer edges of both containers being in parallel immediately adjacent relation to each other, and a separate retainer engaging said outer edges, between the corresponding inner walls, and clamping said common edges toward each other and retaining said containers against each other.

15. The combination of claim 14 wherein said retainer includes a flat elongate panel with opposed ends and opposed edges, an elongate slot defined in said panel extending inwardly from one end thereof, said common outer edges of said two containers being simultaneously received within said slot.

16. The combination of claim 15 wherein said retainer includes a representation of a predetermined motif formed by an integral extension projecting outward relative to at least one of said ends or edges of said panel.

17. The combination of claim 16 wherein said panel, between said slot and each of said edges thereof includes a flat panel portion of substantial transverse width.

* * * * *

UNITED STATES PATENT AND TRADEMARK OFFICE

CERTIFICATE OF CORRECTION

PATENT NO. : 5,538,179

DATED : July 23, 1996

INVENTOR(S) : Liming Cai

It is certified that error appears in the above-indentified patent and that said Letters Patent is hereby corrected as shown below:

Column 7, line 55, change "member" to --means--, and "means" to --member--.

Column 7, line 64, after "tongue" insert --member--.

Column 9, line 4, change "position" to --positioned--.

Signed and Sealed this

Eighteenth Day of February, 1997

*Attest:*

*Attesting Officer*

BRUCE LEHMAN

*Commissioner of Patents and Trademarks*